US007597216B2

(12) United States Patent
Behar et al.

(10) Patent No.: US 7,597,216 B2
(45) Date of Patent: Oct. 6, 2009

(54) FLUID PRODUCT DISPENSER

(75) Inventors: Alain Behar, Suresnes (FR); Laurent Decottignies, Cergy (FR)

(73) Assignee: Airlessystems, Charleval (FR)

( * ) Notice: Subject to any disclaimer, the term of this patent is extended or adjusted under 35 U.S.C. 154(b) by 453 days.

(21) Appl. No.: 10/550,551

(22) PCT Filed: Mar. 22, 2004

(86) PCT No.: PCT/FR2004/000694

§ 371 (c)(1),
(2), (4) Date: Mar. 23, 2006

(87) PCT Pub. No.: WO2004/085287

PCT Pub. Date: Oct. 7, 2004

(65) Prior Publication Data

US 2006/0213927 A1 Sep. 28, 2006

(30) Foreign Application Priority Data

Mar. 24, 2003 (FR) ..... 03 03560

(51) Int. Cl.
*B67D 5/52* (2006.01)

(52) U.S. Cl. ..... 222/135; 222/136

(58) Field of Classification Search ..... 222/135, 222/136, 133, 134, 144.5, 137, 207, 129, 222/168, 145.1
See application file for complete search history.

(56) References Cited

U.S. PATENT DOCUMENTS 3,357,647 A * 12/1967 Marraffino ..... 239/304
3,408,010 A * 10/1968 Fukui ..... 239/308
3,451,593 A 6/1969 Dillarstone
3,670,965 A 6/1972 Marand (Continued)

FOREIGN PATENT DOCUMENTS

DE 93 02 196 U1 6/1994

(Continued)

OTHER PUBLICATIONS

Schuckmann Alfred Von, Translation of Discription, De 93 02 196, Jun. 16, 1994.*

*Primary Examiner*—Kevin P Shaver
*Assistant Examiner*—Robert K Nichols, II
(74) *Attorney, Agent, or Firm*—Sughrue Mion, PLLC

(57) ABSTRACT

A fluid dispenser including a first fluid dispenser member associated with a first fluid reservoir, the first member including a first actuating rod mounted to move along a first rod axis between a rest position and an actuated position, and a second fluid dispenser member associated with a second fluid reservoir, the second member including a second actuating rod mounted move along a second rod axis between a rest position and an actuated position, the first rod having a free end pointing in a first direction and a second rod having a second free end pointing in a second direction, the two members being disposed one relative to the other with the first and second rod axes extending parallel and with the first direction being opposite to the second direction, so that one dispenser member is disposed upside down relative to the other dispenser member, the fluid dispenser being characterized in that at least one of the reservoirs is an "airless" reservoir, with its volume decreasing as fluid is extracted therefrom.

15 Claims, 3 Drawing Sheets

U.S. PATENT DOCUMENTS

| | | | | |
|---|---|---|---|---|
| 3,704,812 | A * | 12/1972 | Marand | 222/136 |
| 3,730,392 | A * | 5/1973 | Marand | 222/82 |
| 5,642,059 | A * | 6/1997 | Scoones | 326/86 |
| 5,947,335 | A | 9/1999 | Milio et al. | |
| 2004/0232168 | A1 * | 11/2004 | Ciavarella et al. | 222/156 |
| 2005/0006409 | A1 * | 1/2005 | Ganzeboom | 222/190 |
| 2005/0263545 | A1 * | 12/2005 | Ophardt | 222/477 |

FOREIGN PATENT DOCUMENTS

| | | | |
|---|---|---|---|
| FR | 2 686 807 | A | 8/1993 |

* cited by examiner

FLUID PRODUCT DISPENSER

The present invention relates to a fluid dispenser comprising two dispenser members such as pumps or valves for dispensing fluids, liquids, or powders. Each dispenser member is associated with a respective reservoir containing fluid. The fluids of the two reservoirs can be of identical type or of different types. This type of dispenser can be referred to as a "dual" dispenser in the fields of perfumes, cosmetics, or indeed pharmaceuticals.

In conventional manner, such dispensers of the dual type are arranged such that the reservoirs are disposed side-by-side. When the dispenser is held in the upright position, the bottoms of the reservoirs are situated at the bottom, and the dispenser members (pumps) are disposed at the tops of the reservoirs. In general, a common dispenser head overlies the two dispenser members. In general, each dispenser member comprises a body inside which an actuating rod is mounted to move axially between a rest position and an actuated position. The actuating rod has a free end that points upwards. In a conventional dual dispenser, both of the rods point upwards. The dispenser head is mounted on and fastened to the free ends of the actuating rods. The actuating head also forms one or two dispensing orifices. To summarize, a dual dispenser is made up of two juxtaposed conventional dispensers, each of which is made up of a reservoir and of a dispenser member, the two dispensers being associated with a common dispenser head that forms the dispensing outlet.

That type of dual dispenser suffers from various drawbacks. Firstly, since the reservoirs are disposed side-by-side, that considerably and necessarily increases the cross-section of the dispenser. Very often, dual dispensers are squat in appearance, with a large dispenser head. Secondly, the push force that it is necessary to apply to the common dispenser head must be greater than the sum of the forces that need to be applied to each actuating rod. As a result, dual dispensers are quite difficult to actuate because they present a very large resistance to actuation. If a dual dispenser is formed by means of standard pumps each requiring a standard actuation force, the push force required for pushing the dispenser head of the dual dispenser is doubled.

An object of the invention is to remedy the above-mentioned drawbacks of the prior art by defining a dual-type dispenser that has a different configuration and whose actuation force or push force can be maintained at a suitable and convenient level, while using standard dispenser members.

Document U.S. Pat. No. 3,451,593 discloses a dual dispenser having two aerosol containers equipped with valves and each containing a fluid under pressure. The containers are disposed one above the other, with the valves facing each other. That dispenser further comprises a common dispenser head to which the two valves are connected. By pushing on the end wall of the container that is disposed upside down, both valves are actuated simultaneously. The fluids from the two containers are then driven towards the dispenser head where they are mixed prior to being dispensed.

The container that is disposed the right way up is provided with a dip tube, while the dispenser that is disposed upside down is not provided with a dip tube. If the user uses said dispenser the wrong way up or tilted, simultaneous dispensing from the two dispensers is no longer achieved.

In addition, the fluids are in contact with the propellant gases in the pressurized containers.

An object of the present invention is to remedy the drawbacks of the above-mentioned prior art dispenser.

To achieve these objects, the present invention provides a fluid dispenser comprising a first fluid dispenser member associated with a first fluid reservoir, said first member comprising a first actuating rod mounted to move along a first rod axis between a rest position and an actuated position, and a second fluid dispenser member associated with a second fluid reservoir, said second member comprising a second actuating rod mounted to move along a second rod axis between a rest position and an actuated position, the first rod having a free end pointing in a first direction and a second rod having a second free end pointing in a second direction, the two members being disposed one relative to the other with the first and second rod axes extending parallel and with the first direction being opposite to the second direction, so that one dispenser member is disposed upside down relative to the other dispenser member, said fluid dispenser being characterized in that at least one of the reservoirs is an "airless" reservoir, with its volume decreasing as fluid is extracted therefrom. Advantageously, the two rod axes coincide. Thus, the present invention proposes to dispose the two dispenser members one above the other with their actuating rods pointing towards each other. One dispenser member is then the right way up, and the other dispenser member is upside down. The reservoirs can thus be disposed one above the other rather than side-by-side as in the prior art. The dispenser can then have an elongate or slender appearance which is more attractive than the squat appearance of the prior art. In addition, the push force that is necessary to actuate the dispenser is merely equal to the larger push force of one of the two dispenser members. In this superposed configuration, the push forces are not summed as they are with the juxtaposed configuration of the prior art. Therefore, the push force necessary for actuating the dispenser of the invention is considerably smaller, since it is merely equal to the push force for the dispenser member that is harder to actuate.

In an advantageous embodiment, the dispenser members are pumps. Advantageously, at least one of the reservoirs is chosen from the group formed of follower piston reservoirs and of variable-volume flexible pouches.

In one embodiment, the dispenser further comprises a pusher mounted to move along a push axis extending parallel to the rod axes, which pusher acts when subjected to a push force to urge one rod free end towards the other rod free end. Advantageously, said pusher acts on one reservoir to move it towards the other reservoir, the actuating rods of the two dispenser members remaining static relative to each other while moving together towards the reservoirs. In one embodiment, the pusher forms a recess for receiving a fluid reservoir. Advantageously, the pusher is provided with axial guide means for axially moving the reservoir that it drives. Preferably, a reservoir is received in a shell, a dispenser head that is common to both of the dispenser members being mounted to slide axially in the shell, said pusher being mounted to slide axially in the shell.

In a practical embodiment, the fluid dispenser further comprises a dispenser head provided with at least one outlet duct opening out at at least one dispensing orifice, said head having two connection sleeves communicating with said at least one outlet duct, and each receiving a respective free end of a respective actuating rod, the two sleeves being constrained to move with each other. Advantageously, the head forms guide means for a dispenser member.

In another aspect of the invention, one dispenser member is situated above its reservoir and the other dispenser member is situated below its reservoir, the dispenser member situated below the reservoir being provided with a vent tube that extends inside the reservoir out of the fluid. In a variant, at least one of the reservoirs is an "airless" reservoir, with its volume decreasing as fluid is extracted therefrom.

The invention is described more fully below with reference to the accompanying drawings which show two embodiments of the invention by way of non-limiting example.

Figure 1:
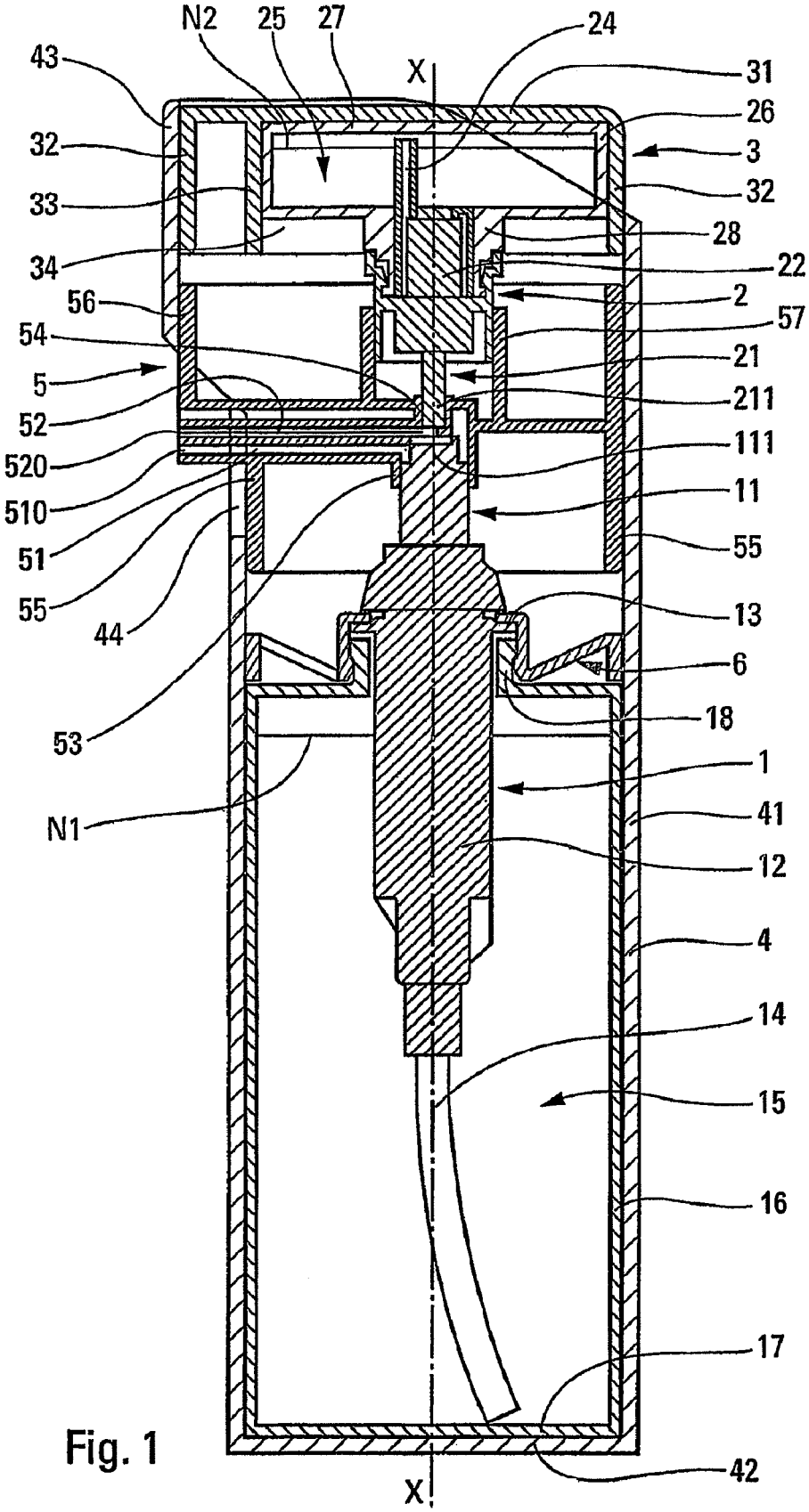
FIG. 1 is a vertical section view through a first embodiment of a fluid dispenser of the invention in the rest position.

In both embodiments used to illustrate the present invention, the fluid dispenser of the invention is a dual dispenser comprising two reservoirs 15, 25, two dispenser members (pumps 1, 2 in this example), and a common dispenser head 5. It is quite possible for valves to be used in place of the pumps, valves being more suitable for dispensing dry powders or powders in suspension.

In the invention, when the dispenser is held in an upright position, which is a rest position when standing on a plane surface but also a normal and logical in-use position, one pump (the pump 1 in this example) is placed or disposed below the pump 2. Thus, the pump 1 is referred to as the "bottom" pump and the pump 2 is referred to as the "top" pump.

The same applies to the reservoirs 15 and 25. The reservoir 15 is the bottom reservoir associated with the bottom pump 1 and the reservoir 25 is the top reservoir associated with the top pump 2. In the embodiments shown in the figures, the reservoir 15 is situated below the pump 1 and the reservoir 25 is situated above the pump 2.

In the invention, the common dispenser head 5 is disposed between the pumps 1 and 2.

It is possible to dispose the reservoirs otherwise relative to the pumps while remaining within the ambit of the invention and while maintaining the advantageous characteristic of having one pump (pump 2 in this example) situated above the bottom pump 1.

In the invention, the bottom pump 1 comprises a body 12 and an actuating rod 11 that is mounted to move axially along a rod axis X-X. Symmetrically, the top pump 2 comprises a pump body 22 and an actuating rod 21 that is mounted to move axially along the same rod axis X-X. Thus, the two rods 11 and 21 are disposed in a manner such that they are aligned on a common rod axis X-X. However, provision can be made for the axes of the rods 11 and 21 not to coincide, but rather merely to be parallel. The rod axes being in alignment is a preferred embodiment.

The rod 11 of the bottom pump 1 has a free end 111 that points upwards in the figures. Symmetrically, the actuating rod 21 of the top pump 2 has a free end 211 that points downwards. When the axes of the rods of the two rods coincide, as applies in the figures, the free end 111 of the rod 11 points towards the free end 211 of the rod 21. More generally, it can be said that the bottom pump 1 is disposed "the right way up", whereas the top pump is disposed upside down.

The free ends 111 and 211 of the rods 11 and 21 are connected to the common dispenser head 5. In the two embodiments of the invention shown in the figures, each of the actuating rods 111 and 211 internally defines an outlet duct via which the fluid pressurized inside the respective one of the pumps is driven when said rods are actuated. The common dispenser head 5 has one or two common dispensing channels opening out at one or two respective dispensing orifices 510, 520. In the various figures, the dispenser head 5 has two distinct dispensing channels 51 and 52 connected to respective ones of the free ends 111 and 211 of the respective actuating rods 11 and 21. Thus, the fluid driven through the actuating rod 11 can then flow via the dispensing channel 51 so as to be discharged at the dispensing orifice 510. Symmetrically, the fluid driven through the actuating rod 21 can flow via the dispensing channel 52 and be discharged at the dispensing orifice 520. In the particular embodiment, the channel 52 extends centrally and axially while the duct 51 extends concentrically around the channel 52. The dispensing orifice 510 is thus in the form of an annular opening surrounding the central dispensing orifice 520. This is merely a particular embodiment. The two channels 51 and 52 can also extend adjacently and can open out at respective ones of two dispensing orifices disposed side-by-side.

Another characteristic common to both of the embodiments shown in the figures lies in the fact that the dispenser comprises an outer shell 4, preferably made of a substantially rigid material. Said shell 4 advantageously contains the bottom reservoir 15, the bottom pump 1, the common dispenser head 5, the top pump 2 and, optionally or in part, the top reservoir 25. The shell 4 has a closed bottom 42 from which a substantially cylindrical drum 41 extends upwards. The drum 41 can be provided with an opening 44 through which the dispensing channels 51, 52 pass so that their respective dispensing orifices extend out of the shell. The shell 4 can serve as means for holding or stabilizing the reservoir 15 and the bottom pump 1, and as guide means for guiding the common dispenser head 5, the top pump 2 and optionally the top reservoir 25. The detailed structure of these various means is described below with reference to the figures.

In the two embodiments, the dispenser has a pusher 3 or 231. The pusher is accessible from the open top end of the shell 4. The shell 4 can be in the form of a tube of circular section or of some other shaped section and whose bottom 42 is closed and whose top end is open. The pusher 3; 231 makes it possible to exert a force in the same direction as the common rod axis X-X. In both of the embodiments in the figures, the pusher acts on the top reservoir 25, and the force is thus transmitted to the top pump 2, to the common dispenser head 5, and to the bottom pump 1, then the pusher acts on the reservoir 15, and finally on the bottom 42 of the shell 4. For example, the user can hold the dispenser in one hand by grasping it by the drum 41 of the shell 4 and can press on the pusher 3; 231 by using one finger of the same hand, e.g. the index finger. This is a quite natural action for actuating a dispenser. Pushing the pusher generates axial displacement of the top pump 2, of the common dispenser head 5, and of the actuating rod 11 of the bottom pump 1, relative to the shell 4 in a direction extending along the common rod axis X-X. More precisely, when the pusher 3; 231 is pushed, the top reservoir 25 is driven downwards with the body 22 of the top pump 2. In the particular embodiments shown in the drawings, the subassembly constituted by the pusher, by the top reservoir 25, and by the body 22 of the top pump 2 moves as a single unit. In addition, the body 12 of the bottom pump 1 and the bottom reservoir 15 are static relative to the shell 4. As a result, they form a bottom static second subassembly. When the top subassembly moves towards the bottom subassembly, this pushes the actuating rod 21 into the body 22 of the top pump 2 and pushes the actuating rod 11 of the bottom pump 1 into the body 12. Since the dispenser head 5 is connected between the two rods, said dispenser head also moves. In the embodiments in the figures, it can be said that the actuating rod 21 moves towards the reservoir 25 and that the actuating rod 11 moves towards the reservoir 15. The common dispenser head 5 moves both towards the reservoir 25 and towards the reservoir 15, while, at the same time, moving downwards relative to the shell 4.

With this particular configuration of the pumps 1 and 2, i.e. with the pumps being superposed and with the top pump being disposed upside down, the push force necessary to push the pusher is merely equal to the actuating force for actuating the pump that is harder to actuate. If both of the pumps have the same load or resistance to actuation, the push force on the pusher is merely equal to the load of one pump, and not to the sum of the loads of the two pumps, as applies when the two pumps are disposed side-by-side with their actuating rods pointing the same direction. The push force necessary for actuating the dispenser is thus reduced considerably. In addition, the dispenser can have an elongate and attractive appearance, rather than a squat appearance like prior art dual dispensers in which the two reservoirs are disposed side-by-side.

Figure 2:
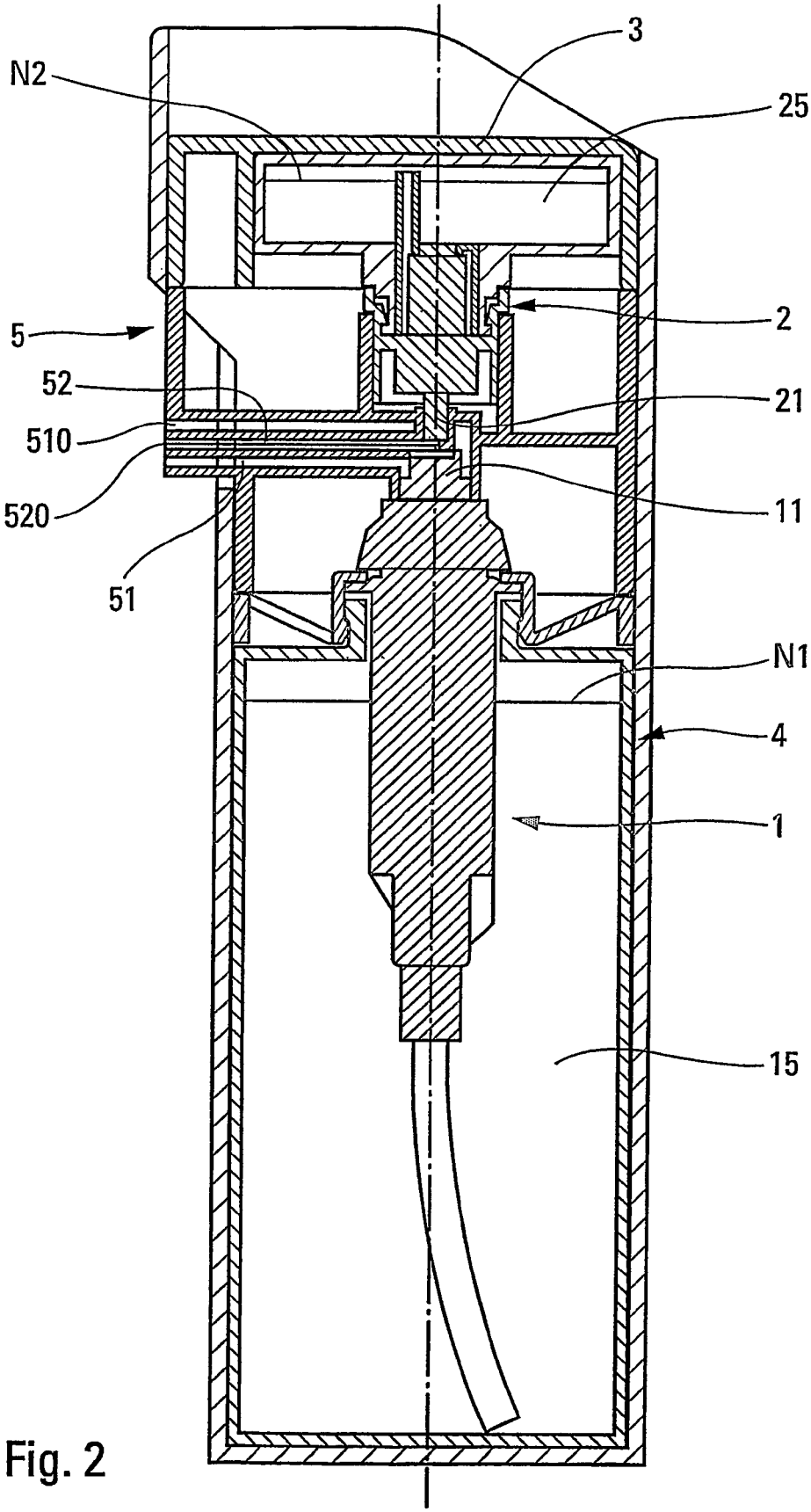
FIG. 2 is a view of the FIG. 1 dispenser in the actuated position.

Reference is made below to FIGS. 1 and 2 in order to explain the first embodiment of the invention in more depth. The bottom reservoir 15 is defined by a receptacle 16 which is rigid or semi-rigid. The receptacle 16 has a bottom 17 that can come into abutment against the bottom 42 of the shell 4. The outside diameter of the receptacle 16 can be chosen in a manner such that it can be inserted substantially snugly into the drum 41 of the shell 4. Thus, the receptacle 16 is held securely inside the shell 4 at its bottom 17 and also at its sidewall. At its end opposite from the bottom 17, the receptacle 16 has a neck 18 which defines an opening that puts the reservoir 15 into communication with the outside. The pump 1 is disposed in part in the opening formed by the neck 18. The body 12 is provided with a fastening collar 17 in abutment against the top end edge of the neck 18. A fastening ring 6 is used to hold the collar 13 on the neck 18. In this example, the ring 6 is a snap-fastening ring that comes to co-operate with the outside of the neck 18. The ring 6 also has an outer band that comes into engagement with the inside wall of the drum 41 of the shell 4 so as to hold the pump 1 and the receptacle 16 securely inside the shell 4. Since the receptacle 16 is rigid or semi-rigid, the pump 1 is provided with a dip tube 14 that extends into the reservoir 15 to the bottom 17. In the upright position, the level N1 of the fluid inside the reservoir 15, when said reservoir is full, is situated at or immediately below the neck 18.

The top reservoir 15 is formed by a rigid or semi-rigid receptacle 26 defining a neck 28 in which the pump 2 is fastened by means of any fastening system. For example, a conventional fastening ring can be used. The receptacle 26 has an end wall 27 at its top. The level N2 of the fluid inside the reservoir 25, when said reservoir is filled, is situated substantially at the level of the end wall 27. Since the receptacle 26 is rigid, and therefore substantially non-deformable, it is necessary to compensate for the volume of fluid extracted from the reservoir by a substantially corresponding volume of air. For this purpose, the top pump 2 is provided with a vent tube 24 that extends inside the reservoir 25 substantially to the top end wall 27.

In this example, the receptacle 26 is associated with a pusher 3 having a push top surface 31 around the edge of which a guide skirt 32 extends downwards. Said skirt 32 also forms a recess 34 in association with a flange 33, the recess receiving the receptacle 26 in stable and stationary manner. Then end wall 27 comes into contact with the push surface 31. The peripheral guide skirt 32 is adapted to slide in non-leaktight manner inside the shell 4. More precisely, the shell 4 defines a guide projection 43 situated immediately above the dispensing orifices 510, 520. The guide skirt 32 is substantially cylindrical and has a shape substantially corresponding to the shape of the section of the shell 4 at said projection 43. Thus, the pusher 3 can move axially and with excellent stability along the common axis X-X.

In addition to its two dispensing channels 51 and 52, the dispenser head 5 has two connection sleeves 53 and 54 for respective ones of the free ends 111 and 121 of the respective actuating rods 11, 21. The head 5 also has a guide socket 57 inside which the top pump 2 or its fastening ring can move axially and stably along the common axis X-X. In addition, the head 5 has a plurality of guide walls 55, 56 serving to slide in non-leaktight manner inside the shell 4 in order to guarantee that the head 5 moves axially and stably along the common axis X-X.

Thus, by pushing on the push surface 31 of the pusher 3, the push force is transmitted to the top end-wall 27 of the reservoir 25, and then to the top pump 2, thereby pushing the actuating rod 21 thereof into the body 22. Symmetrically, the push force pushes the actuating rod 11 into the body 12 of the bottom pump 1. As a result the dispenser head 5 moves downwards slightly. Concomitantly, the respective fluids coming from the actuating rods 11 and 21 flow through the dispensing channels 51 and 52 to reach the dispensing orifices 510, 520 simultaneously or consecutively. It is possible to provide pumps that have the same dispensing capacity, or else pumps that have different dispensing capacities. It is also possible to choose pumps that have the same load or resistance to actuation, or else pumps that have different loads or resistances to actuation. This influences the quantity of fluid dispensed and the sequence of dispensing of the fluids at the respective dispensing orifices. It is easier to choose pumps that have the same load or resistance to actuation.

Figure 3:
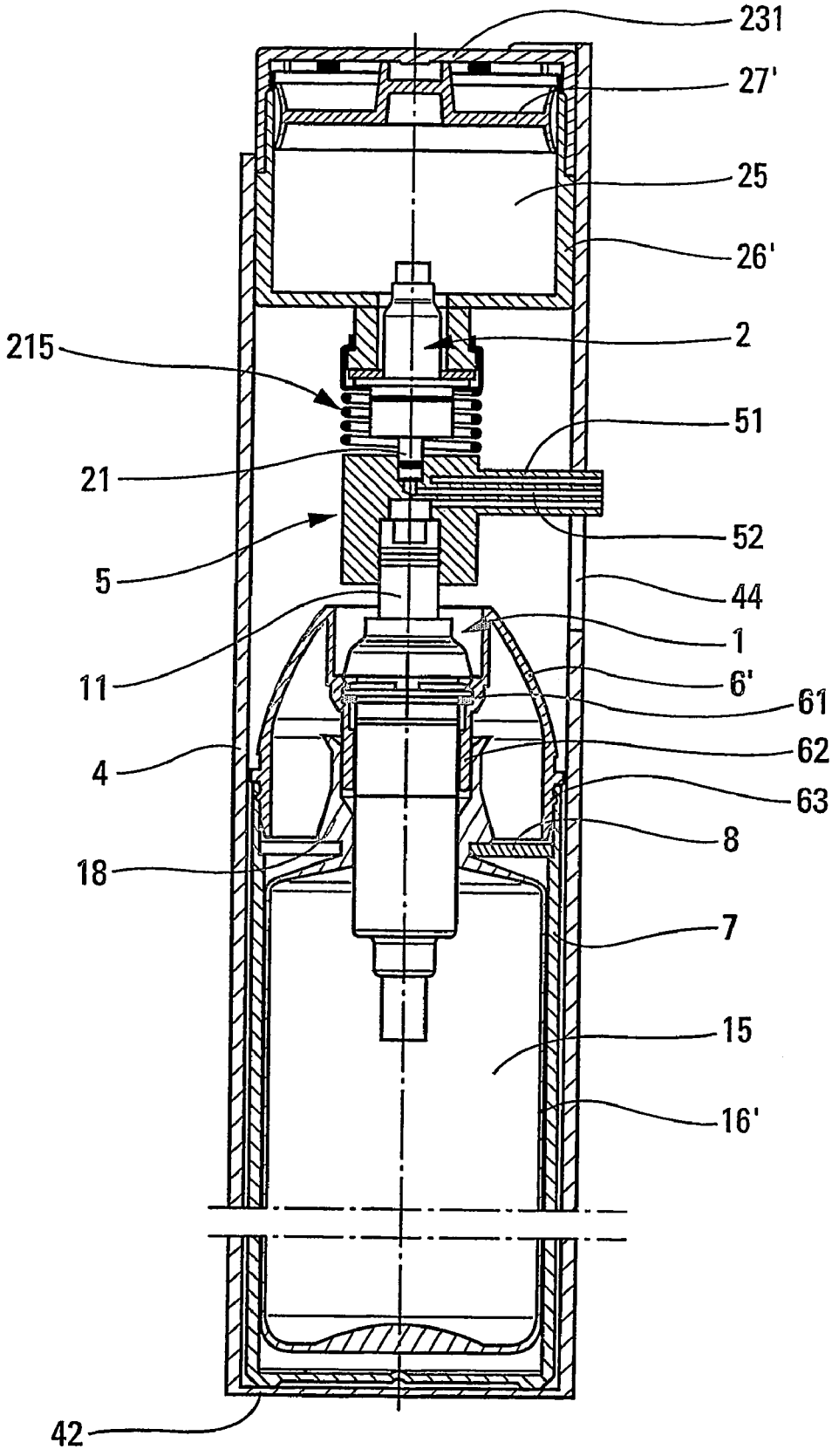
FIG. 3 is vertical section view through a second embodiment of a fluid dispenser of the invention in the rest position.

Reference is made below to the embodiment in the FIG. 3. The pumps 1 and 2 can be identical to the pumps of the first embodiment. The same applies for the head 5. The main difference relative to the preceding embodiment lies in the reservoirs 15 and 25. The reservoir 15 is defined by a deformable receptacle 16' which can, for example, be made by injection molding. It is also possible to use a freely deformable pouch made from a laminated film. The advantage with this type of deformable receptacle 16' is that the working volume of the reservoir 15 decreases as the fluid is extracted via the pump. In this embodiment in FIG. 3, the receptacle 16' is a pouch made by injection molding having a substantially rigid neck 18. The receptacle 16' is held inside a rigid casing 7 via a holding element which is in the form of a collar surrounding the neck 18 and coming into engagement via its outside periphery with the inside of the rigid casing 7. The pump 1 is disposed inside the neck 18 and held in place by means of a fastening ring 6' which defines a fastening recess 61 for the pump 1 and a locking band 63 which comes into engagement with the rigid casing 7 for locking the holding element 8 in place.

The top reservoir 25 is constituted by a rigid receptacle 26' inside which a scraper or follower piston 27' is disposed. The function of the follower piston is to move as the fluid is dispensed by the pump 2 so as to reduce the working volume of the reservoir 25. Thus, exactly like a deformable receptacle, the follower piston system makes it possible to dispense fluid without air being taken into the reservoir. In this example, the pusher 231 is formed by a cap mounted on the open end of the rigid receptacle 26'. It can even be said that the cap defines the end wall of the receptacle 26'.

Another feature of this embodiment lies in the use of an adjustment spring 215 disposed between the pump 2 and the dispenser head 5. The spring 215 makes it possible to modify the load or the resistance to actuation of the pump. The stiffness of the adjustment spring 215 is added to the stiffness of the internal return spring of the pump that urges the actuating rod towards its rest position. Thus, the total load of the assembly formed by the pump and by the adjustment spring can be set to a desired value by using a suitable adjustment spring. It is thus the adjustment spring that makes it possible to set the total load. It is thus possible to obtain a dual dispenser equipped with two different pumps that can have any loads or resistances to actuation: the adjustment spring 215 makes it possible to set the actuation load of one pump relative to the actuation load of the other pump. For example, this makes it possible to balance the loads of the two pumps. This also makes it possible to unbalance the loads of the two pumps. As regards dispensing, this makes it possible to determine the sequence of dispensing from the two pumps. The fluid from one pump can be dispensed before the fluid from the other pump. It is also possible to obtain simultaneous dispensing. It is thus possible to obtain desired, sequenced dispensing of the fluids from the two pumps. It is also possible to act on the cross-section and on the width of each of the dispensing channels in order to determine the dispensing sequence.

By using an "airless" reservoir, it is possible to omit the dip tube and the vent tube of the first embodiment. It is also possible to see that the pusher can be merely in the form of an end wall of a reservoir receptacle. The shell 4 is also very easy to manufacture and makes it possible to mask all of the component elements of the dual dispenser.

The invention claimed is:

1. A fluid dispenser comprising a first fluid pump dispenser member (1) associated with a first fluid reservoir (15), said first member comprising a first actuating rod (11) mounted to move along a first rod axis between a rest position and an actuated position, and a second fluid pump dispenser member (2) associated with a second fluid reservoir (25), said second member comprising a second actuating rod (21) mounted to move along a second rod axis between a rest position and an actuated position, the first rod (11) having a free end (111) pointing in a first direction and the second rod (21) having a second free end (211) pointing in a second direction, the two members being disposed one relative to the other with the first and second rod axes extending parallel and with the first direction being opposite to the second direction, so that one dispenser member is disposed upside down relative to the other dispenser member, at least one of the reservoirs being an airless reservoir, with its volume decreasing as fluid is extracted therefrom, said fluid dispenser being characterized in that one of the dispenser members has an internal return spring that urges the actuating rod towards its rest position, said fluid dispenser being provided with a load adjustment spring (215) suitable for modifying the actuation load of said member so that the stiffness of the adjustment spring is added to the stiffness of the internal return spring.

2. A fluid dispenser according to claim 1, in which the two rod axes coincide.

3. A fluid dispenser according to claim 1, further comprising a pusher (3, 231) mounted to move along a push axis extending parallel to the rod axes (11, 21), said pusher acting when subjected to a push force to urge one rod free end (211) towards the other rod free end (111).

4. A fluid dispenser according to claim 3, in which said pusher (3, 231) acts on one reservoir (25) to move it towards the other reservoir (15), the actuating rods (111, 211) of the two dispenser members remaining static relative to each other while moving together towards the reservoirs.

5. A fluid dispenser according to claim 4, in which the pusher (3) forms a recess (34) for receiving a fluid reservoir (25).

6. A fluid dispenser according to claim 4, in which the pusher (3) is provided with axial guide means (32) for axially moving the reservoir (25) that it drives.

7. A fluid dispenser according to claim 6, in which a reservoir (15) is received in a shell (4), a dispenser head (5; 5') that is common to both of the dispenser members (12) being mounted to slide axially in the shell, said pusher (3) being mounted to slide axially in the shell (4).

8. A fluid dispenser according to claim 1, further comprising a dispenser head (5) provided with at least one outlet duct (51, 52) opening out at least one dispensing orifice (510, 520), said head (5; 5') having two connection sleeves (53, 54) communicating with said at least one outlet duct, and each receiving a respective free end (111, 211) of a respective actuating rod (11, 21), the two sleeves being constrained to move with each other.

9. A fluid dispenser according to claim 7, in which the head (5) forms guide means (57) for a dispenser member.

10. A fluid dispenser according to claim 1, in which one dispenser member (1) is situated above its reservoir (25) and the other dispenser member (2) is situated below its reservoir (25), the dispenser member situated below the reservoir being provided with a vent tube (24) that extends inside the reservoir (25) out of the fluid.

11. A dispenser according to claim 1, in which the dispenser members (1, 2) are pumps.

12. A dispenser according to claim 1, in which at least one of the reservoirs is chosen from the group formed of follower piston reservoirs and of variable-volume flexible pouches.

13. A fluid dispenser comprising:

a first fluid pump dispenser member for dispensing fluid from a first fluid reservoir, the first fluid dispenser member comprising a first actuating rod mounted to move along a first rod axis between a rest position and an actuated position of the first fluid dispenser member;

second fluid pump dispenser member for dispensing fluid from a second fluid reservoir, the second fluid dispenser member comprising a second actuating rod mounted to move along a second rod axis between a rest position and an actuated position of the second fluid dispenser member; and wherein the first rod has a free end facing a first direction and the second rod has a second free end facing a second direction, wherein the first fluid dispenser member and the second fluid dispenser member are disposed relative to each other with the first and second rod axes extending parallel and with the first direction opposite the second direction, so that one of the first and second dispenser members is disposed upside down relative to the other of the first and second fluid dispenser members;

wherein at least one of the first and second fluid reservoirs is an airless reservoir such that the airless reservoir's volume decreases as fluid is extracted therefrom;

wherein the first fluid dispenser member comprises a return spring internal to the first fluid dispenser member that urges the first actuating rod towards the rest position of the first fluid dispenser member; and wherein the fluid dispenser further comprises a load adjustment spring that increases the load required to actuate the first fluid dispenser member.

14. The dispenser according to claim 13, wherein the load adjustment spring is disposed outside of the first and second fluid dispenser members.

15. The dispenser according to claim 14, wherein the load adjustment spring is disposed around at least a portion of one of the first and second fluid dispenser members.

* * * * *